US006540523B1

(12) United States Patent
Kung et al.

(10) Patent No.: US 6,540,523 B1
(45) Date of Patent: Apr. 1, 2003

(54) CONNECTION BASE ASSEMBLY FOR MEMORY CARDS AND A DETECTOR THEREOF

(75) Inventors: Gary Kung, Taipei Hsien (TW); Kuo Cheng Wang, Taipei Hsien (TW)

(73) Assignee: I/O Interconnect Inc., Taipei Hsien (TW)

( * ) Notice: Subject to any disclaimer, the term of this patent is extended or adjusted under 35 U.S.C. 154(b) by 0 days.

(21) Appl. No.: 10/061,243

(22) Filed: Feb. 4, 2002

(30) Foreign Application Priority Data

Dec. 19, 2001 (TW) ..... 90222288 U

(51) Int. Cl.[7] ..... H01R 12/00

(52) U.S. Cl. ..... 439/64; 439/61; 439/541.5

(58) Field of Search ..... 439/64, 541.5, 439/630, 631, 632, 945, 946, 188, 634, 635, 639, 61, 62; 361/737; 200/61.59, 47, 246, 283, 51.05, 51.06, 51.07

(56) References Cited

U.S. PATENT DOCUMENTS 6,097,605 A * 8/2000 Klatt et al. ..... 361/737
6,115,242 A * 9/2000 Lambrecht ..... 361/684
6,234,844 B1 * 5/2001 Somerville et al. ..... 439/630
6,386,920 B1 * 5/2002 Sun ..... 439/630
6,399,906 B1 * 6/2002 Sato et al. ..... 200/61.59
6,425,775 B1 * 7/2002 Chang et al. ..... 439/188
6,468,101 B2 * 10/2002 Suzuki ..... 436/326
2001/0029127 A1 * 10/2001 Higuchi ..... 439/541.5
2001/0039129 A1 * 11/2001 Nishimura ..... 439/74

* cited by examiner

*Primary Examiner*—P. Austin Bradley
*Assistant Examiner*—Ross Gushi
(74) *Attorney, Agent, or Firm*—Troxell Law Office PLLC

(57) ABSTRACT

A for memory cards comprises a base part and four guide piece sections. The base part is an integrated casing made by way of injection molding and provides a longitudinal spacing wall and two transverse partitions between an upper wall and a lower wall and between two lateral walls of a rear wall thereof respectively based on the width and the height of each of different types memory cards such that the front side thereof is formed with four slot sockets. Each of the slot sockets is provided with a plurality of grooves or engaging recesses corresponding to the number of signal terminals on the respective memory card. The guide piece sections are corresponding to the slot sockets respectively and each of the guide piece sections is located in and fixed to the corresponding one of the slot sockets and is composed of metal guide pieces corresponding to the number of the grooves and the engaging recesses. The metal guide pieces are bent and inserted into the grooves and the engaging recesses. Each of the guide pieces at an end thereof is a contact end received in the slot sockets and another end thereof is a connecting end. Once the base part is fixed to a circuit board and the respective guide piece at the connecting end thereof being soldered to the circuit board, each of the signal terminals can touch the contact end of the respective guide piece as soon as the different types memory cards are inserted into the respective corresponding slot socket, and the memory cards can be read out or written in data.

10 Claims, 10 Drawing Sheets

CONNECTION BASE ASSEMBLY FOR MEMORY CARDS AND A DETECTOR THEREOF

BACKGROUND OF THE INVENTION

1. Field of the Invention

The present invention relates to a connection base assembly for memory cards, and particularly to an integrally formed connection base assembly, which can be in conjunction with the circuit board swiftly and provides four slot sockets with modularized layout and arrangement available for being inserted with six different types memory cards. In addition, the present invention further relates to a detector for a security digital card.

2. Description of Related Art

The flash memory serving as a loader of data storage really brings extremely convenient for the information industry, and, especially, it is beneficial for the main memory that it is unnecessary to offer a huge space while a single independent or temporary data is saved. Meanwhile, the specific data can be saved and managed well through a single memory.

Usually, the memory cards used for the consumptive electronic product, such as the digital camera, the MP3 player or the PDA, mostly can be classified into six standard memory cards, the multi-media card (MMC), the secure digital card (SD), the smart media card (SM), the compact flash card (CF) including type I and type II and the memory stick card (MS). Wherein, the only difference between the SD card and the MMC card is the number of contact pins so that a common slot socket of the read and write apparatus is enough for both of the cards.

However, the read and write apparatus for the memory cards available on the market mostly only provides a slot socket for a specific memory card to perform the operation of read and write such that the users have to prepare a read and write apparatus corresponding to a certain memory card used in the consumptive product. Hence, it is tedious that a slot socket is unable to accommodate different memory cards and it results in inconvenience that the read and write apparatuses have to be inserted to or detached from the computer frequently. In order to overcome the deficiency, a read and write apparatus adapted to multiple memory cards has been developed.

The read and write apparatus adapted to multiple memory cards basically provides at least two connection bases at the facial side and the reversed side of the circuit board respectively so that the exposed slot socket can be inserted with memory cards with different types and specifications for data read and write. However, the defect of the preceding read and write apparatus resides in that different types connection bases are mounted to the upper level or the lower level of the circuit board individually so that a complicate structure is formed and the procedure and the labor increase while the assembling job is conducted. As a result, it causes extra production cost and is not an effective solution for the read and write apparatus.

SUMMARY OF THE INVENTION

A connection base for memory cards according to the present invention comprises a base part and four guide piece sections. The base part is an integrated casing made by way of injection molding and provides a longitudinal spacing wall and two transverse partitions between an upper wall and a lower wall and between two lateral walls of a rear wall thereof respectively based on the width and the height of each of different types memory cards such that the front side thereof is formed with four slot sockets. Each of the slot sockets is provided with a plurality of grooves or engaging recesses corresponding to the number of signal terminals on the respective memory card. The guide piece sections are corresponding to the slot sockets respectively and each of the guide piece sections is located in and fixed to the corresponding one of the slot sockets and is composed of metal guide pieces corresponding to the number of the grooves and the engaging recesses. The metal guide pieces are bent and inserted into the grooves and the engaging recesses. Each of the guide pieces at an end thereof is a contact end received in the slot sockets and another end thereof is a connecting end. Once the base part is fixed to a circuit board and the respective guide piece at the connecting end thereof being soldered to the circuit board, each of the signal terminals can touch the contact end of the respective guide piece as soon as the different types memory cards are inserted into the respective corresponding slot socket, and the memory cards can be read out or written in data.

BRIEF DESCRIPTION OF THE DRAWINGS

The present invention can be more fully understood by referencing to the following detailed description and accompanying drawings, in which.

DETAILED DESCRIPTION OF THE PREFERRED EMBODIMENTS

Figure 1A:
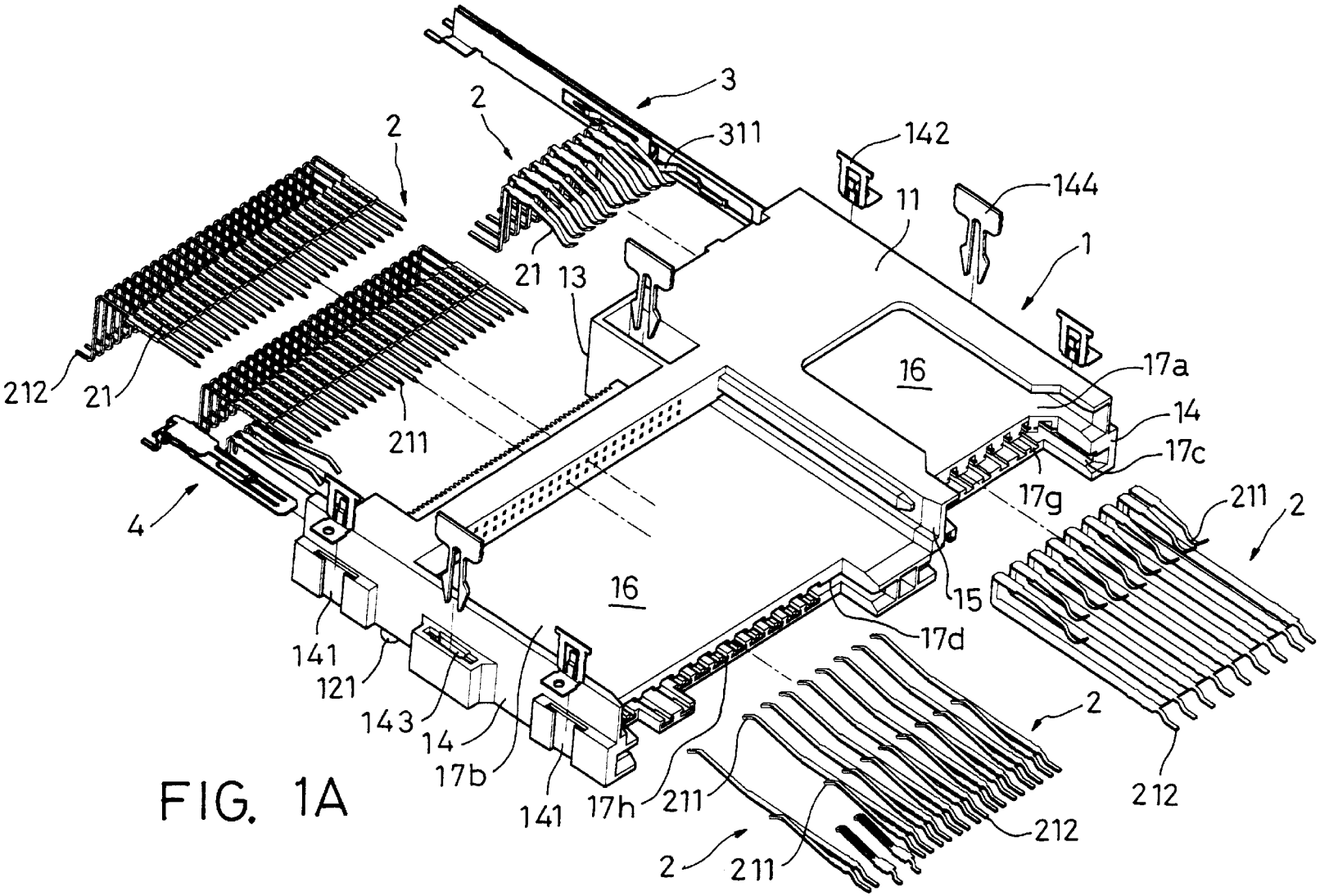
FIGS. 1A and 1B are exploded perspective views of a connection base assembly for memory cards according to the present invention in different projection angles.
Figure 1B:
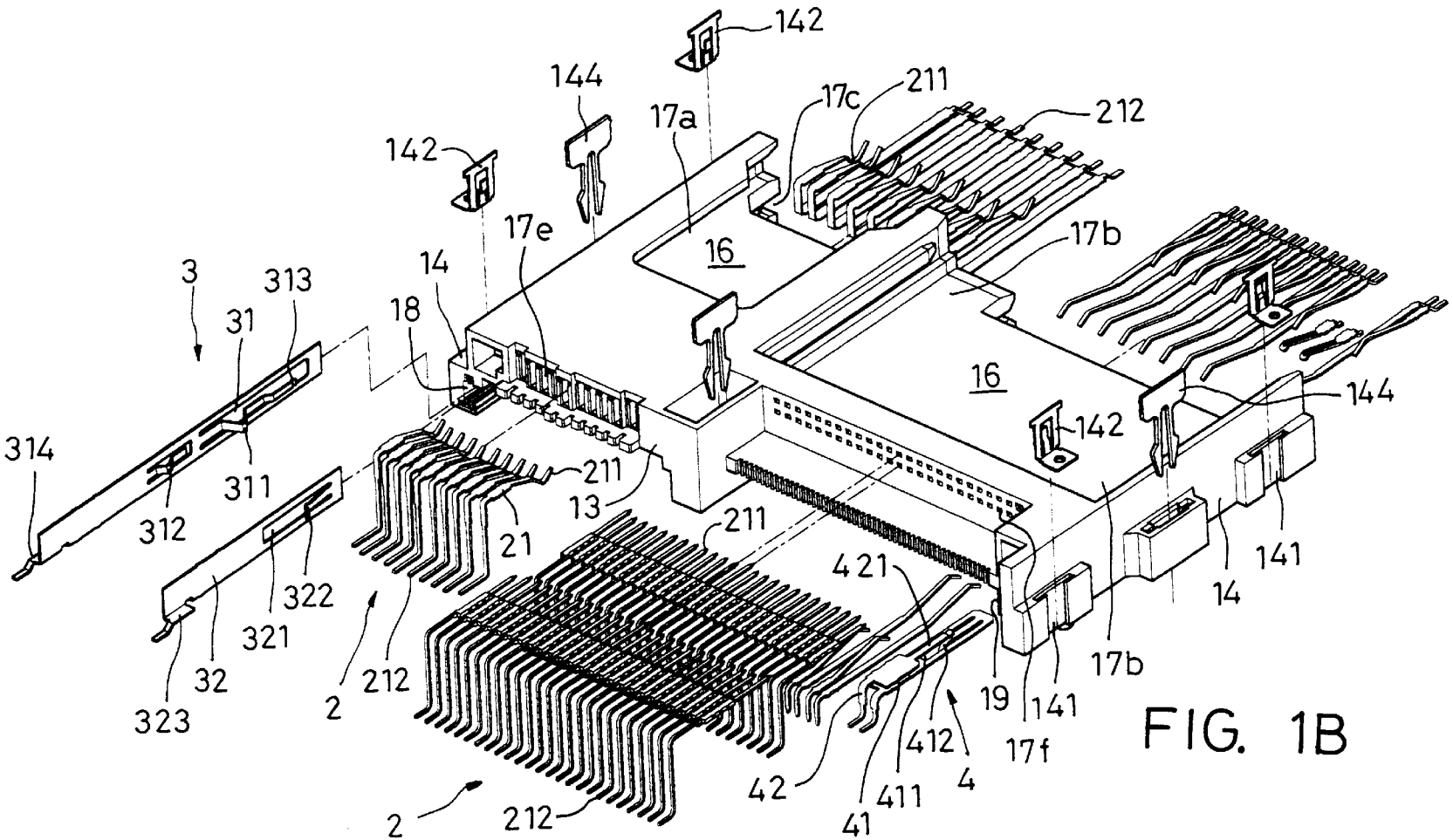
Figure 2:
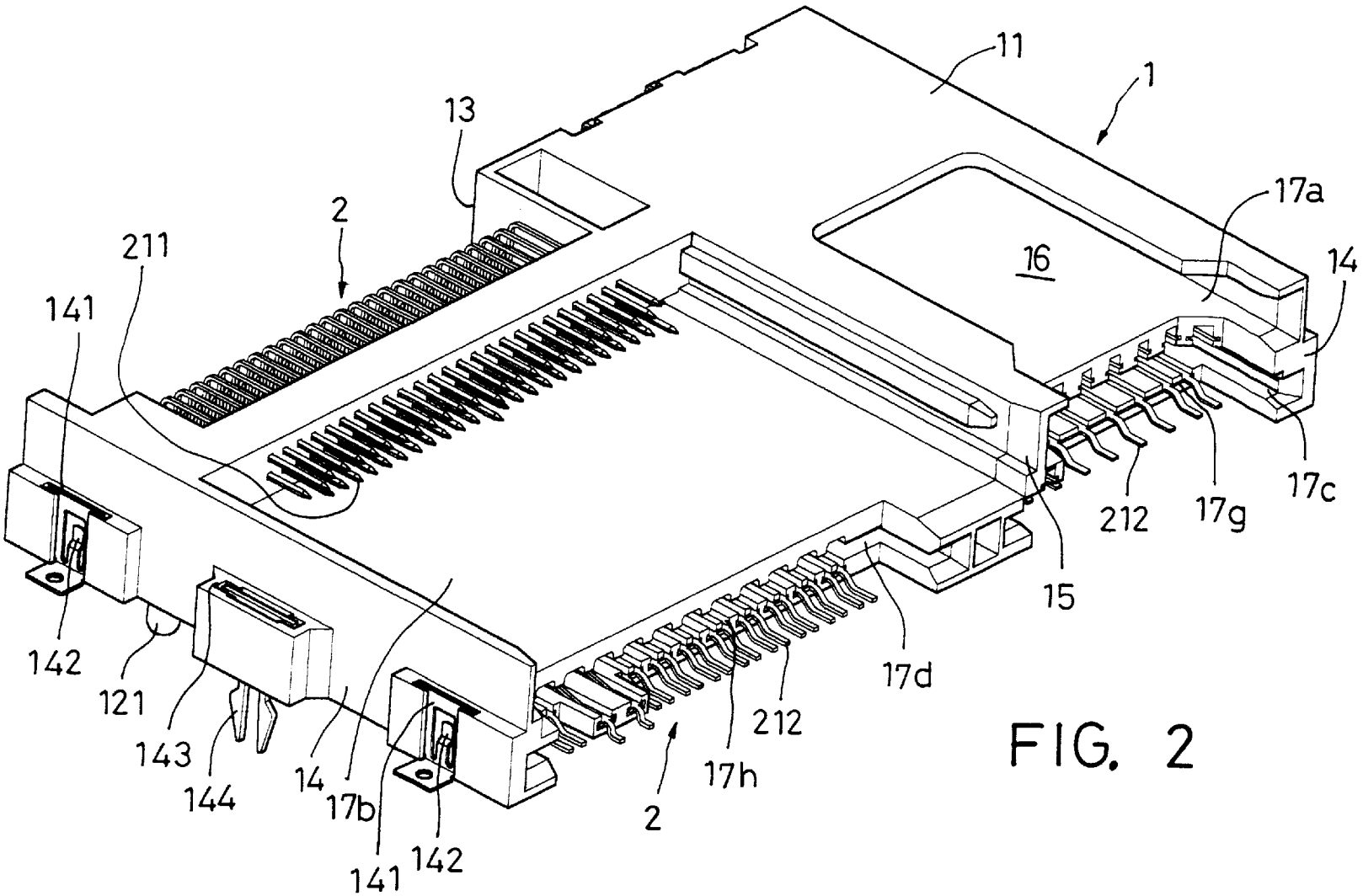
FIG. 2 is an assembled perspective view of the connection base assembly shown in FIG. 1A.
Figure 3:
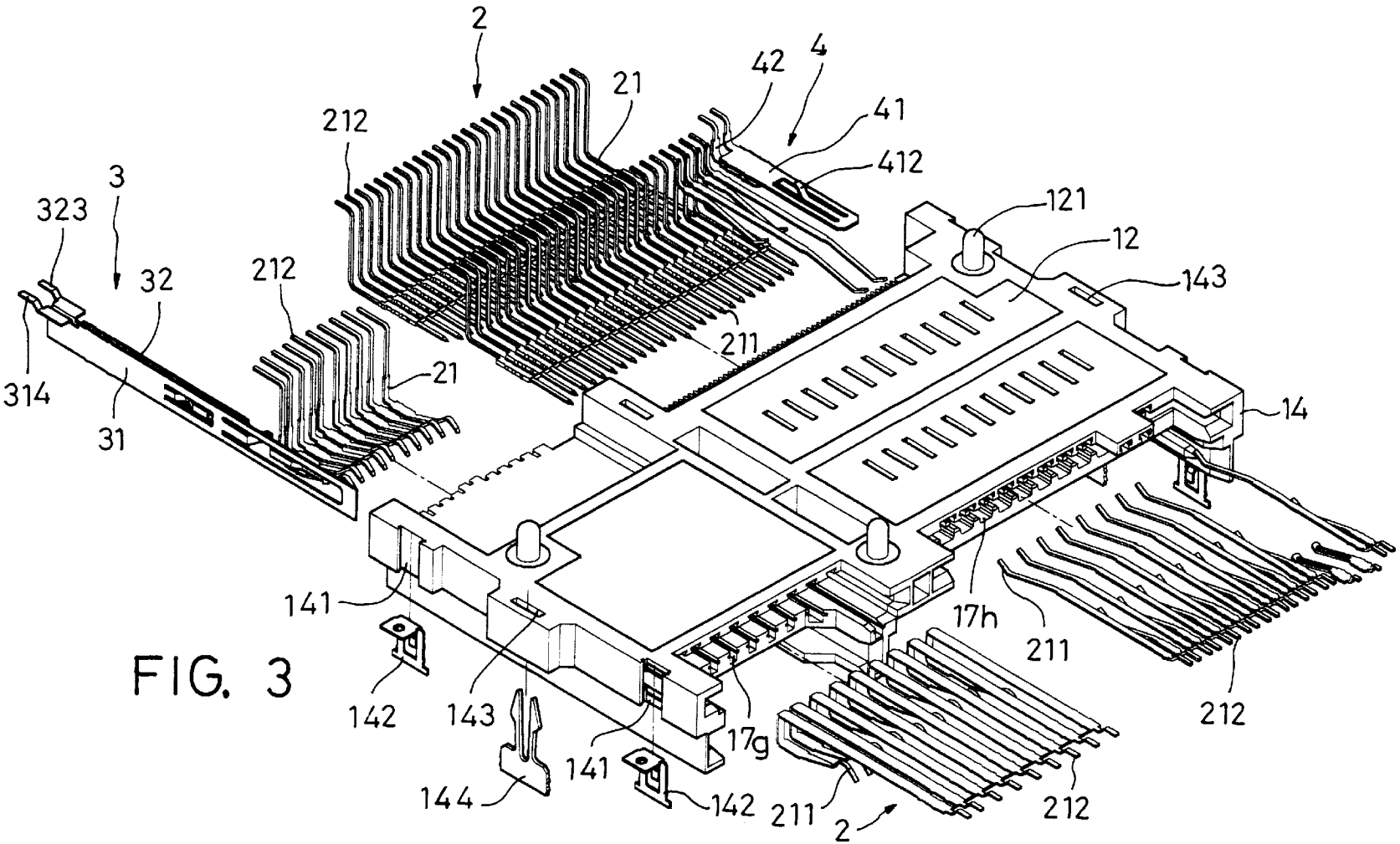
FIG. 3 is an exploded perspective view of the connection base assembly of the present invention projecting from the rear side thereof.
Figure 4:
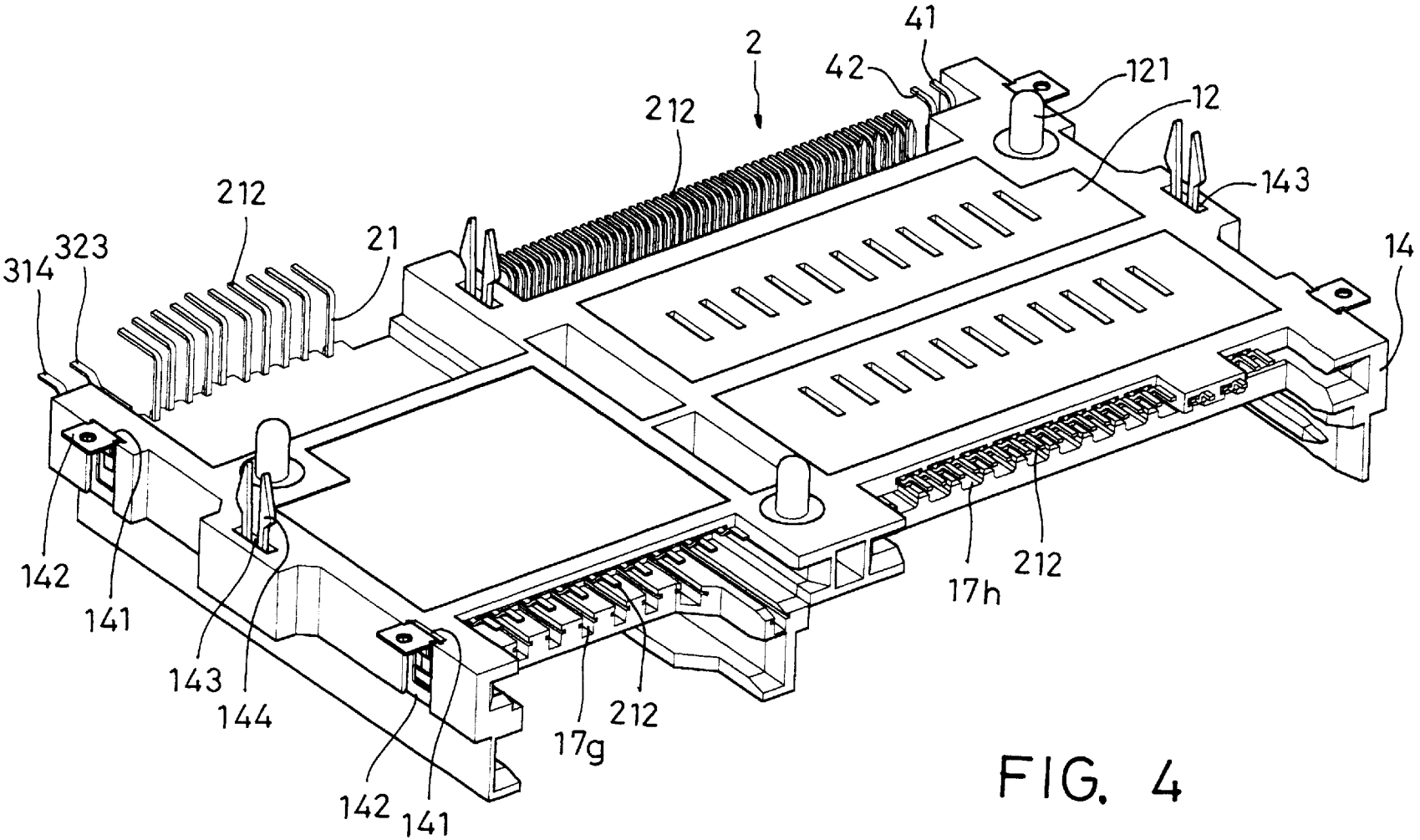
FIG. 4 is an assembled perspective view of FIG. 3.

Referring to FIGS. 1 to 4, a connection base assembly for memory cards basically comprises a base part 1, four guide sections 2, a SD card detector 3 and a MD card detector 4.

Wherein, the base part 1 is an integrated casing made by way of injection molding and a spacing wall 15 and two partitions are provided in the base part 1 between an upper wall 11 and a lower wall and between two lateral walls 14 of a rear wall 13 thereof according to the modularized arrangement for the width and the height of respective memory card, for instance, according to the widths and the heights of the SD card, the MMC card, the MC card and the SM card such that the base part 1 at the front side thereof is formed with four inserted socket 17*a*–17*d* possible for accommodating different types memory cards. For instance, the socket 17*a* is suitable for the MS card, the socket 17*b* is suitable for type I or II of CF card, the socket 17*c* is suitable for the SD card and the MMC card and the socket 17*d* is suitable for SM card, respectively.

In order to connect with each memory card electrically, the slot sockets 17*a* and 17*b* at the rear wall 13 have a groove 17*e* and 17*f* respectively in accordance with the number of signal terminals on the MS card and the CF card and locations for the guide plate section 2 being inset to and located at the grooves 17*e*, 17*f*. The slot sockets 17*c* and 17*d* at the lower wall 12 have engaging recesses 17*g* and 17*h* respectively for the guide plate section 2 being inset to and located at the grooves 17*c* and 17*d*. In addition, the slot sockets 17*c* and 17*d* at the lateral walls 14 have a base recess 18 and a card recess 19 respectively for receiving and locating the SD card detector 3 and a SM card detector 4.

Further, in order to join with the circuit board faster, the base part 1 at the two lateral walls 14 and/or the spacing wall 15 may provides a plurality of locating slots 141 and engaging slots 143 for receiving and locating connection pieces 142 and insert pieces 144 such that the end connection pieces 142 are soldered to the circuit board and the insert pieces 144 are inserted into the circuit board so as to be fixed to the circuit board. Besides, a plurality of locating projections 121 extend from the lower wall 12 to engage with locating holes preset on the circuit board such that the base part 1 can be held to the circuit board for further soldering job and insertion job.

Each guide piece section 2 is composed of a plurality of bent metal guide pieces 22 corresponding the grooves 17*e*, 17*f* and engaging recesses 17*g*, 17*h* and being inserted into the grooves 17*e*, 17*f* and the engaging recesses 17*g*, 17*h*. Wherein, each of the metal guide pieces 21 at an end thereof is a contact end 211 being disposed in the inserted sockets 17*a*–17*d* so as to contact with signal terminals on any type memory card and at the other end thereof is a connecting end 212, which is soldered to the circuit board by way of surface melting technique (SMT) to form a close circuit so as to perform an operation of read or write to any type memory card.

Figure 9:
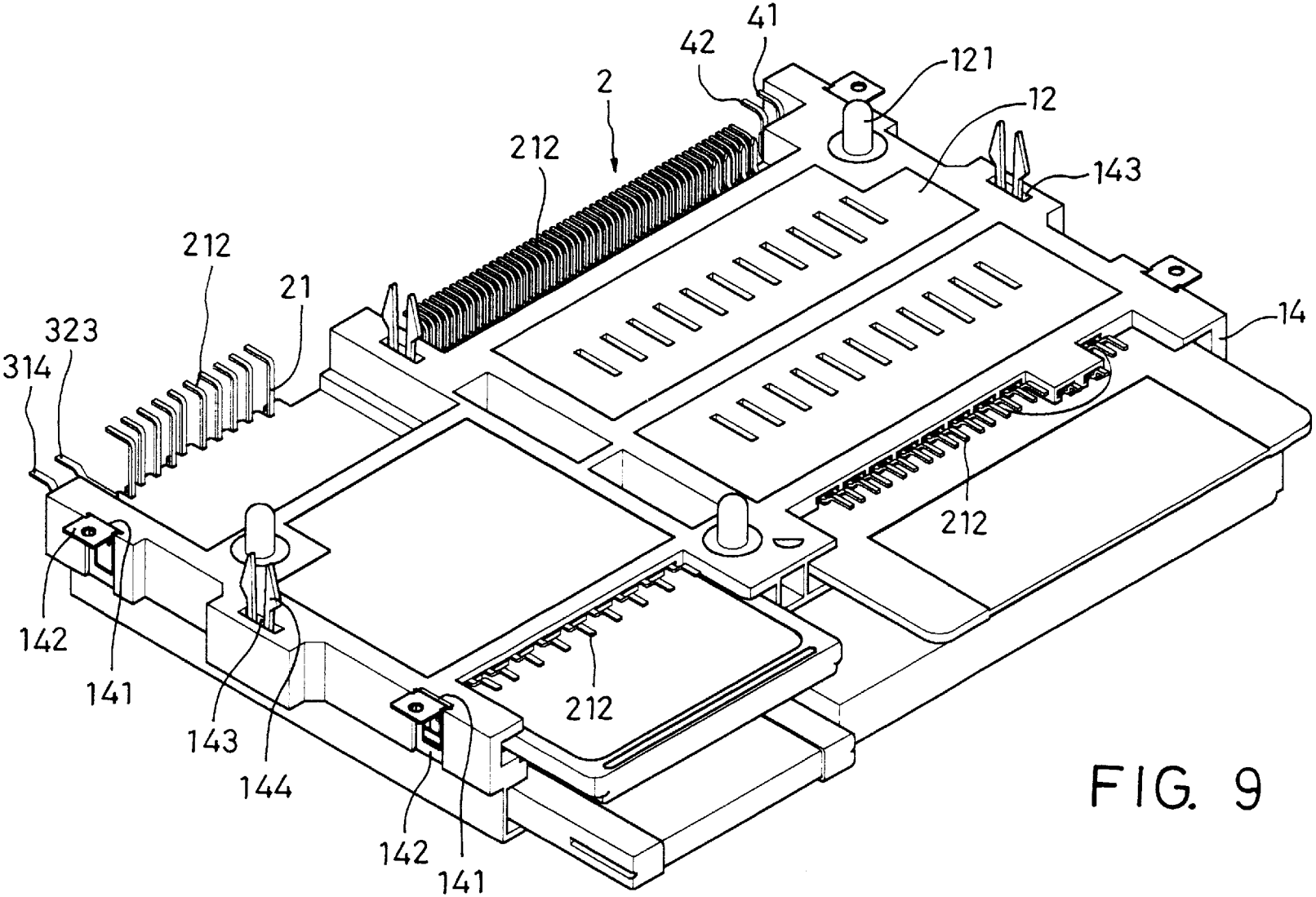
FIG. 9 is a perspective view illustrating the connection base assembly of the present invention in a state of being inserted with four different memory card simultaneously.

Moreover, the base part matches each guide piece section 2 well, and, especially, each of the metal guide pieces inserted into the inserted socket 17*c* is a shape of capital "J" so that the contact end 211 thereof remains bending upward to facilitate the facial side (label side) of the SD card and the MMC card facing the same direction as the facial side of the SM card, the CF card and the MS card for the user being able to recognize while the card is in use (see FIG. 9).

Figure 5:
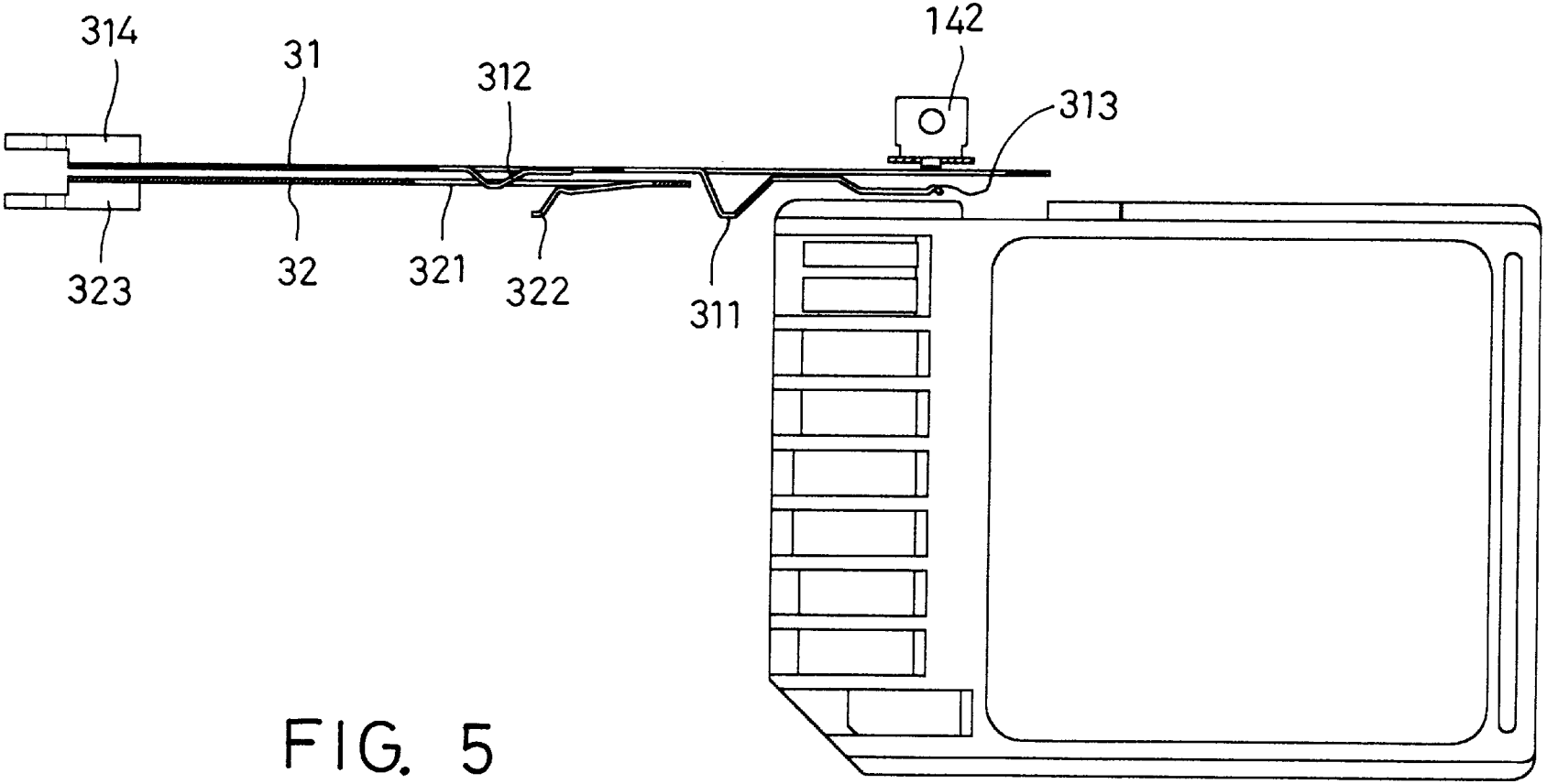
FIG. 5 is a plan view illustrating a SD card before contacting with the detector.
Figure 6:
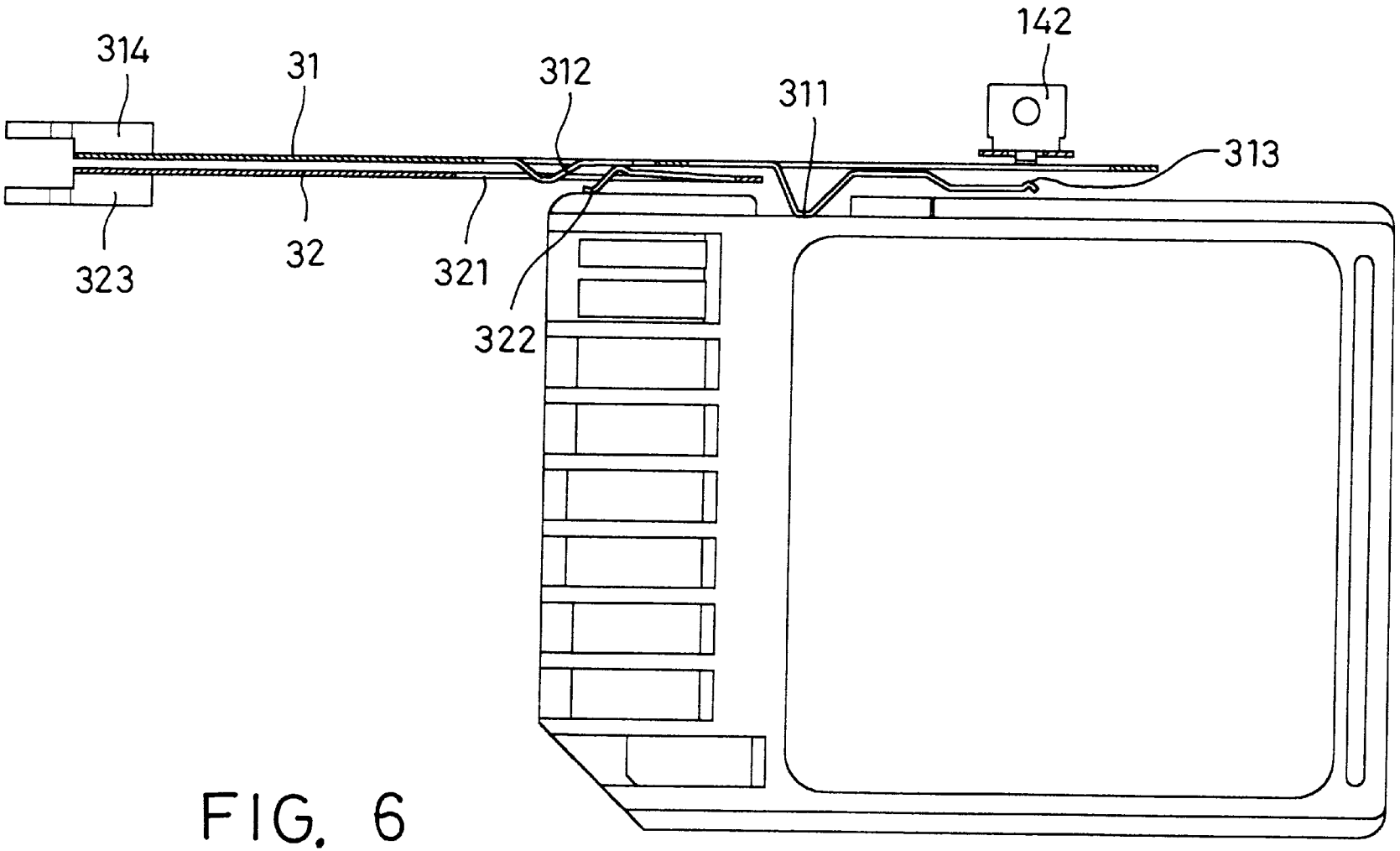
FIG. 6 is a plan view illustrating the SD card after contacting with the detector.
Figure 7:
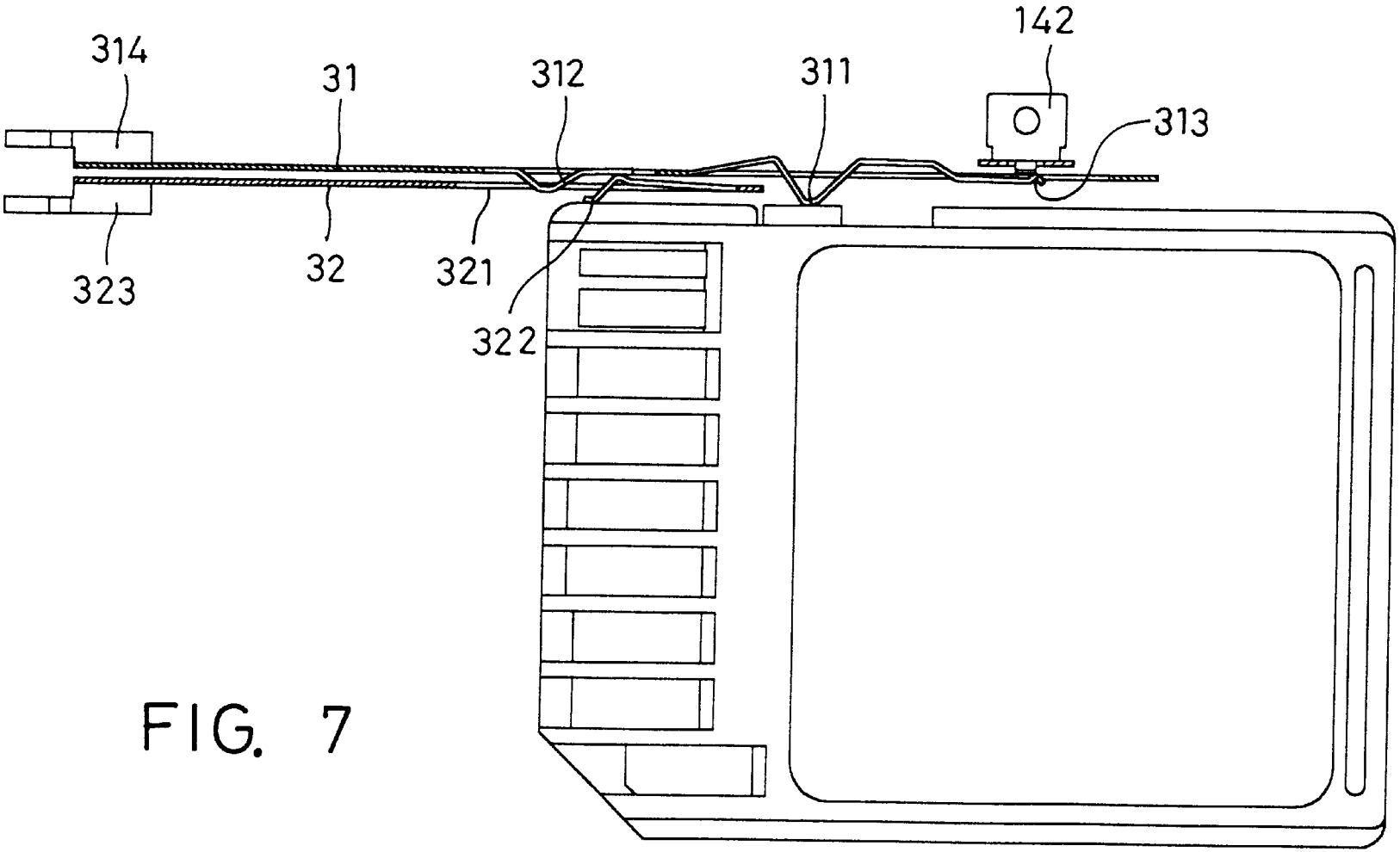
FIG. 7 is another plan view illustrating the SD card after contacting with the detector.

Referring to FIGS. 5 to 7, a detector for SD card according to the present invention is illustrated. The detector 3 is composed of a detection plate 31 and a control plate 32, which are inserted into the base recess 18 in a way of spacing apart from each other. The detecting plate 311 at two plate grooves thereof provides a detecting part 311 and a switch part 312 with both of them having a resilient bent respectively. The detecting part 311 at an end thereof is a free end 313. The control plate 32 has a plate groove 321 to receive the switch part 312 and extends a contact 322 to keep a clearance off the switch part 312. Besides, the detection plate 31 and the control plate 32 at the rear ends thereof are fixed ends 314, 323 for being soldered to the circuit board. The detection plate 31 and the control plate 32 keep spacing apart from each other as shown in FIG. 5 before the SD with a switch lock SW being inserted into the socket 17*c*.

In case of the switch lock SW being in a state of locking, the contact part 322 and the detecting part 311 touch lateral walls of the SD card immediately as soon as the SD card is inserted into the slot socket 17*c*. Once the SD card has been well placed in the slot socket 17*c*, the contact part 322 touches the switch part 312 against the lateral walls of the SD card to ground both of the detection plate 31 and the control plate 32 and the detecting part 311 falls into a gap in front of the switch lock SW (as shown in FIG. 6). This means the SD card can process read only and it is not possible to perform the job of write.

In case of the switch lock SW of the SD card being in a state of unlocking, the contact part 322 and the detecting part 311 touch lateral walls of the SD card immediately as soon as the SD card is inserted into the slot socket 17*c*. Once the SD card has been well placed in the slot socket 17*c*, the contact part 322 and the free end 313 displaces resiliently to touch the switch part 312 and the end connection part 142 respectively against both of the lateral walls of the SD card and the switch lock SW such that the detection plate 31 grounds with the control plate 32 and the end connection part 142 respectively (as shown in FIG. 7). This means the SD card can process the operation of write.

Accordingly, the present invention can distinguish which state of the switch lock SW of the SD is in by way of the detection plate 31 and the control plate 32 only. Comparing to the conventional detecting apparatus, the detector of the present invention performs more accurate detection job and provides better availability of space, definitely.

Figure 8A:
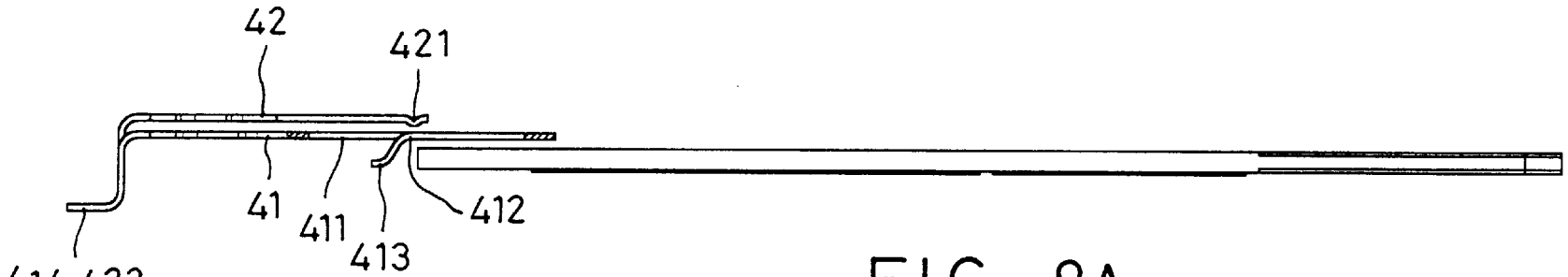
FIGS. 8A and 8B are plan views illustrating a SM card before and after contacting with another detector respectively.
Figure 8B:
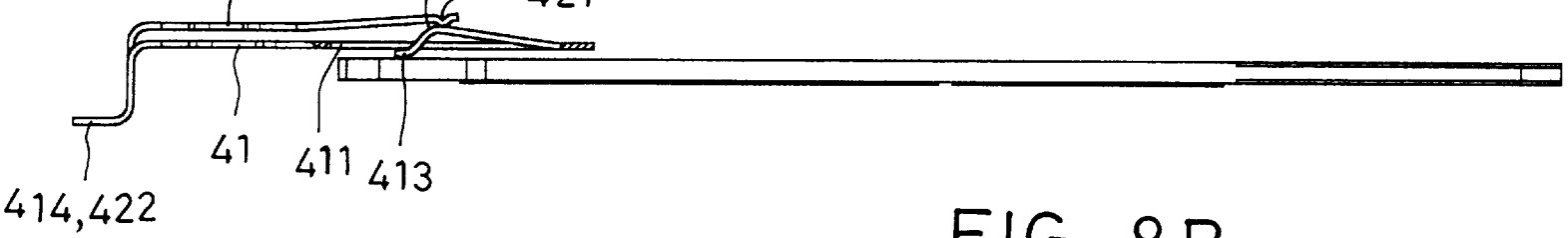

Referring to FIGS. 8A and 8B, a detector for a SM card is illustrated and it can be seen that the detector 4 provides a sense piece 41 and an extension piece 42, which are inserted into the card groove 19 in a way of spacing apart from each other. The sense piece 41 has a frame groove 411 and a resilient bent sense part 412 is disposed in the frame groove 411 with a free end 413. The extension piece 42 extends a contact part 421 being disposed corresponding to the sense part 412. Both of the sense piece 41 and the extension piece 42 at the rear ends thereof are a fixed end 414, 412 soldered to the circuit board. The sense part 412 and the contact part 421 keep spacing apart from each other before the SM card being inserted into the slot socket 17*d* so that a close circuit is not formed.

As soon as the SM card is inserted into the slot socket 17*d*, the free end 413 is pressed by the SM card to urge the sense part 412 moving toward the contact part 421. Once the sense part 412 touches the contact part 421 and a grounding is formed, it means the SM card has been inserted into and well placed in the slot socket (as shown in FIG. 8B) such that data can be read from the SM card and data can be written into the SM card.

It is appreciated from the preceding embodiment of the present invention that the connection base assembly has involved a thought of modularization, which is in accordance with sizes and features of different types memory cards, to realize a single base assembly providing with four properly arranged slot sockets in a limited space. The base assembly used in the present invention can be made integrally via injection molding so that it not only makes the mass production possible but also does not increase extra expenses due to setting up each guide piece section and the connection of the circuit being about the same as the conventional ones. Furthermore, the entire connection base assembly can be fixed to the circuit board fast by way of the end connection part, the insert part and the locating projection being utilized so that it much simplifies the procedure of the assembling job to lower down the complexity of the product and the time used for the assembling job is lowered greatly for a low production cost if compares to the prior art, which provides a circuit board with an upper and a lower layers for being soldered with different types connecting bases.

While the invention has been described with reference to a preferred embodiment thereof, it is to be understood that modifications or variations may be easily made without departing from the spirit of this invention, which is defined by the appended claims.

What is claimed is:

1. A connection base for memory cards, comprising:

a base part, being an integrated casing made by way of injection molding, providing a longitudinal spacing wall and two transverse partitions between an upper wall and a lower wall and between two lateral walls of a rear wall thereof respectively based on a width and a height of each of different types memory cards such that a front side thereof is formed with four slot sockets, and each of the slot sockets being provided with a plurality of grooves or engaging recesses corresponding to the number of signal terminals of the respective memory card; and four guide piece sections, being corresponding to the slot sockets respectively and each of the guide piece sections being located in and fixed to the corresponding one of the slot sockets and being composite of a plurality of metal guide pieces corresponding to the number of the grooves and the engaging recesses, the metal guide pieces being bent and inserted into the grooves and the engaging recesses, and each of the guide piece at an end thereof being a contact end received in the slot sockets and another end thereof being a connecting end;

whereby, once the base part is fixed to a circuit board and the respective guide piece at the connecting end thereof being soldered to the circuit board, each of the signal terminals can touch the contact end of the respective guide piece as soon as the different types memory cards are inserted into the respective corresponding slot socket, and the memory cards can be read out or written in data.

2. The connection base for memory cards according to claim 1, wherein a first one and a second one of the slot sockets are adjacent to the circuit board and can be inserted with and connect with a smart media card (SM), a secure digital card (SD) and a multimedia card (MMC) respectively.

3. The connection base for memory cards according to claim 1, wherein the two lateral walls provides a plurality of locating slots for receiving and locating a plurality of end connection pieces and the end connection pieces are soldered to the circuit board such that the base part can be associated with circuit board.

4. The connection base for memory cards according to claim 1, wherein the two lateral walls and/or the spacing wall my provide a plurality of engaging slots for receiving and locating a plurality of insert pieces and the insert pieces are inserted into the circuit board such that the base part can be associated with the circuit board.

5. The connection base for memory cards according to claim 1, wherein the lower wall may extends a plurality of locating projections to pass through a plurality of locating holes preset on the circuit board such that the base part can be located at the circuit board.

6. The connection base for memory cards according to claim 1, further comprises a detector being disposed in a base recess formed with lateral walls of the slot socket for being inserted with the SD card and the base recess at a front side thereof communicating with an end connecting part; the detector comprises:

a detecting plate, being a bent metal piece and inserted into the base recess, providing two plate grooves extending a resilient bent detecting part and a bent resilient bent switch part, the detecting plate at an end thereof being a free end and at another end thereof being fixed to the circuit board by way of soldering; and a control plate, being a bent metal piece and inserting into the base recess, keeping spacing apart from the detecting plate, having a plate groove to receive a switch part and extending a contact part to keep a clearance off the switch part, and having a rear end being soldered to the circuit board;

whereby, once the SD card is inserted into the corresponding slot socket, the contact part is pressed by the lateral walls of the SD card to touch the switch part and to form grounding and the detecting piece at the free end thereof contacts with the end connecting piece selectively in accordance with a switch lock arranged on the SD such that an open circuit or grounding can be formed to detect the switch lock being in a state of locking or unlocking.

7. The connection base for memory cards according to claim 1, further comprises another detector disposed a card groove formed at the lateral walls of the slot socket for the SM card, and said another detector comprises:

a sense piece, being a bent metal piece and inserted into the card groove, having a frame groove and a bent sense part being disposed in the frame groove with a slant extending free end and another end being fixed to the circuit board by way of soldering;

an extension piece, being a bent metal piece and being inserted into the card groove, keeping spacing apart from the sense part, providing a contact part being disposed corresponding to the sense part, and at a rear end thereof being fixed to the circuit board by way of soldering;

whereby, once the SM card is inserted into the corresponding slot socket, the free end is pressed and the sense piece displaces to touch the contact part such that a grounding can be formed so as to detect if the SM card is in a state of being located or not.

8. The connection base for memory cards according to claim 1, wherein each guide piece of the guide piece sections is bent as a letter "J" with a contact part thereof being disposed at an upper side thereof such that a facial side of the SD card (the side providing a label) is in accordance with a facial side of the SM card, the CF card or the MS card.

9. A detector of a connection base for memory cards, comprising:

a slot socket, providing a plurality of engaging recesses corresponding to the number of signal terminals on a SD card for a plurality of metal guide pieces being inserted and located, receiving a contact part at an end of each of the guide pieces and each of the guide pieces at another end thereof being a connection end fixed to a circuit board by way of soldering, and providing a base groove formed by lateral walls thereof, and a front side thereof communicating with an end connecting piece;

a detecting plate, being a bent metal piece and inserted into the base recess, providing two plate grooves extending a resilient bent detecting part and a bent resilient bent switch part, the detecting plate at an end thereof being a free end and at another end thereof being fixed to the circuit board by way of soldering; and a control plate, being a bent metal piece and inserting into the base recess, keeping spacing apart from the detecting plate, having a plate groove to receive a switch part and extending a contact part to keep a clearance off the switch part, and having a rear end being soldered to the circuit board;

whereby, once the SD card is inserted into the corresponding slot socket, the contact part is pressed by the lateral walls of the SD card to touch the switch part and to form grounding and the detecting piece at the free end thereof contacts with the end connecting piece selectively in accordance with a switch lock arranged on the SD such that an open circuit or grounding can be formed to detect the switch lock being in a state of locking or unlocking.

10. The connection base for memory cards according to claim 9, wherein each guide piece of the guide piece sections is bent as a capital "J" with a contact part thereof being disposed at an upper side thereof.

* * * * *